US006533154B2

(12) United States Patent
Kitai et al.

(10) Patent No.: US 6,533,154 B2
(45) Date of Patent: Mar. 18, 2003

(54) NIPPING ROLLER GAP ADJUSTING DEVICE

(75) Inventors: Mitsuo Kitai, Yokohama (JP); Takanobu Sakakura, Inagi (JP); Yuuji Iiizumi, Kawasaki (JP)

(73) Assignee: Tokyo Kikao Seisakusho Ltd. (JP)

( * ) Notice: Subject to any disclaimer, the term of this patent is extended or adjusted under 35 U.S.C. 154(b) by 0 days.

(21) Appl. No.: 09/878,263

(22) Filed: Jun. 11, 2001

(65) Prior Publication Data

US 2002/0014509 A1 Feb. 7, 2002

(30) Foreign Application Priority Data

Jul. 28, 2000 (JP) ..... 2000-228224

(51) Int. Cl.[7] ..... B65H 20/02
(52) U.S. Cl. ..... 226/177; 226/187
(58) Field of Search ..... 226/176, 177, 226/187

(56) References Cited

U.S. PATENT DOCUMENTS 4,048,831 A * 9/1977 Fabian et al. ..... 226/177 X
4,060,187 A * 11/1977 Grob ..... 226/177 X
4,360,260 A * 11/1982 Eloranta et al. ..... 396/584
4,368,837 A * 1/1983 Bodewein ..... 226/176
4,415,108 A * 11/1983 Katoh ..... 226/176 X
4,842,180 A * 6/1989 Kato ..... 226/176
5,072,872 A * 12/1991 Casset et al. ..... 226/176
5,738,264 A 4/1998 Jackson et al. ..... 226/177
5,961,022 A * 10/1999 Pfeiffer et al. ..... 226/176

FOREIGN PATENT DOCUMENTS

JP 4-164780 5/1992
JP 2818161 8/1998

* cited by examiner

*Primary Examiner*—Kathy Matecki
*Assistant Examiner*—Minh-Chau Pham
(74) *Attorney, Agent, or Firm*—McGlew and Tuttle, P.C.

(57) ABSTRACT

The gap adjusting device for nipping rollers is provided with one roller rotatably provided at a prescribed position and the other movable roller. The nipping rollers are adapted so that the other roller is capable of forcing a paper web passing between the two rollers onto the one roller. A nipping-roller gap adjusting device includes a pair of supporting arms, one end of each of the supporting arms being swingably supported and the other end thereof rotatably supporting the other roller. A pressing force imparting device gives to the support arms a force working in such a direction that causes the other roller to approach the one roller and which, at the same time, can adjust the magnitude of the force. A minimum gap setting device can set a minimum gap between the one roller and the other roller. A gap adjusting device adjusts the size of a gap between the one roller and the other roller. A fixed frame member rotatably supports the one roller. The gap adjusting device is mounted on the fixed frame.

10 Claims, 3 Drawing Sheets

NIPPING ROLLER GAP ADJUSTING DEVICE

BACKGROUND OF THE INVENTION

1. Field of the Invention

The present invention relates to a nipping-roller gap adjusting device in a newspaper rotary press.

2. Description of the Prior Art

In a newspaper rotary press, pairs of nipping rollers, each of which comprises a stationary roller and a movable roller that can move away from the stationary roller and approach the stationary roller, are used to feed a printed paper web to a folding device. In order to adapt to the number of folded sheets of paper web and a difference in the thickness of paper web, it is desirable that the gap of the nipping rollers be adjustable. Apparatuses disclosed in Japanese Patent Publication No. 2818161 and Japanese Published Unexamined Patent Application No. Hei-4(1992)-164780, for example, are known as apparatuses for adjusting the gap of nipping rollers.

In the prior art nipping-roller gap adjusting device disclosed in the former patent (Japanese Patent Publication No. 2818161), a pressing force directed toward the stationary roller side is given by a compression spring to a lever which supports a movable roller, and a stopper for gap adjustment sets the gap between the stationary roller and the movable roller. Furthermore, the movable roller is adapted to be detached from the stopper during the passage of a paper web.

More specifically, the rotational axis of one roller, which constitutes the stationary roller, is rotatably supported by a frame, and the other roller, which constitutes the movable roller, is installed side by side with respect to the stationary roller, and rotatably supported in the middle of a lever, one end of which is supported by a separate shaft provided in parallel to the roller axis. Furthermore, a gap adjusting means is connected to the other end of the lever. The gap adjusting means has an adjusting screw which is screwed to a bobbin nut installed at the other end of the lever. A sleeve is movably fitted onto the periphery of the adjusting screw, and a flange is installed at an end of the sleeve on the apparatus-frame side. Adjacent to this flame are fixed an engaging collar and a handle.

The flange of the sleeve, along with the engaging collar, constitutes a stopper; the two members, when brought into contact with each other, prevent the lever from moving toward the stationary roller side to a larger extent than necessary. Therefore, in a case where a web having a thickness larger than a set gap size passes, the end face of the engaging collar moves away from the end face of the flange of the sleeve, thereby generating a gap between the two. The rotary press is normally operated in this state. Furthermore, a male thread is provided on the peripheral surface of the sleeve, and the bobbin nut and a compression spring holder installed on the apparatus frame are screwed to the threaded portion of the sleeve. The compression spring is installed so that it is interposed between the compression spring holder and the lever.

The roll-gap adjustment setting by the roll gap adjusting device of the above construction is performed by rotating the adjusting screw by means of the handle, thereby to increase and decrease the distance between the bobbin nut installed on the other end of the lever and the bobbin nut installed in the apparatus frame. Furthermore, the pressing force is adjusted by rotating the compression spring holder screwed into the sleeve.

In the prior art disclosed in the latter patent (Japanese Published Unexamined Patent Application No. Hei-4(1992)-164780), there are provided a stationary roller, a movable roller, and a support member that can move the movable roller by means of an air cylinder. The gap of nipping rollers is set by adjusting the phase of this support member by means of an eccentric pin.

In setting the roller gap, the support member is first detached from the eccentric pin by operating the air cylinder. Next, by operating an index handle the eccentric pin is caused to undergo rotational displacement, thereby to set the gap between the stationary roller and the movable roller to a desired value. The air cylinder is then operated to bring the support member into contact with the eccentric pin. As a result, the gap between the stationary roller and the movable roller is adjusted to the desired gap.

With the prior-art nipping-roller gap adjusting device disclosed in the former patent, when gap adjustment is performed during operation by means of a swinging lever, special skills are required because of the swinging motion of the lever itself, and accurate adjustment is hard to be accomplished even by skilled operators. Furthermore, because the gap adjusting mechanism and the mechanism of adjusting the pressing force are integrally constructed, the gap adjusting mechanism are complex and a large number of pants are needed. Therefore, relatively frequent maintenance is necessary and the system is prone to troubles.

When a thick paper sheet with a thickness larger than a thickness setting, such as a spliced part of paper webs, passes, an impact load generated by the passage of the thick paper sheet is applied to the adjusting mechanism, posing the problem that irregularities such as deformation and misalignment occur in the adjusting mechanism. Furthermore, accumulation of paper dust, etc. on the adjusting screw portion makes gap adjustment impossible.

In the prior art disclosed in the latter patent, a machine in operation must be temporarily stopped to perform gap adjustment and hence gap adjustment during the operation of the machine is impossible. Furthermore, because the gap adjusting mechanism and the mechanism of adjusting the pressing force are integrally constructed, almost the same problems as with the prior art disclosed in the former arise although the gap adjusting device of the latter is a little simpler in construction than that of the former.

SUMMARY OF THE INVENTION

It is an object of the present invention to provide a nipping-roller gap adjusting device which solves various problems as mentioned above in a rotary press provided with nipping rollers as described above, and which enables the gap adjustment of nipping rollers to be easily and accurately performed by everyone with a machine kept in operation. It is another object of the invention is to provide a nipping-roller gap adjusting device which has a simplified nipping-roller gap adjusting mechanism and a simplified mechanism of adjusting a pressing force, which does not require much maintenance, and which is less apt to suffer breakdowns.

In the invention, there is provided a nipping-roller gap adjusting device for use in a rotary press provided with a roller rotatably installed in a prescribed position and another movable roller to form nipping rollers, wherein the movable roller can force a paper web passing through the two rollers onto the stationary roller. As the essential features of the invention this nipping-roller gap adjusting device comprises; a pair of supporting arms, one end of each of the supporting arms being swingably supported and the other end thereof rotatably supporting the movable roller; a pressing force imparting means which gives to the supporting arms a force working in such a direction that causes the movable roller to approach the stationary roller and which, at the same time, can adjust the magnitude of the pressing force; a minimum gap setting means which can set a minimum gap between the stationary roller and the movable roller; a gap adjusting means which adjusts the size of a gap between the stationary roller and the movable roller; and a fixed frame member which rotatably supports the stationary roller and on which the gap adjusting means is mounted.

As the essential features of the invention, the gap adjusting means comprises an eccentric cam rotatably installed on the peripheral surface of a bearing sleeve which is rotatably supports one roller and a worm gearing for the rotary operation of the cam.

A paper web passing through the two rollers is pressed against one roller by accomplishing angular displacement in a direction in which a pair of supporting arms rotatably supporting the other roller is caused to approach the one roller, through the use of the pressing force imparting means which is installed in the supporting arms and which can adjust the magnitude of a force working on the supporting arms, a minimum gap between the one roller and the other roller is set through the use of the minimum gap setting means, and the size of a gap between the two rollers is adjusted through the use of the gap adjusting means installed in a supporting member rotatably supporting the one roller. Furthermore, the pressing force is obtained by giving an adjustable resilience of a compression spring to the supporting arms.

DETAILED DESCRIPTION OF THE PREFERRED EMBODIMENTS

Figure 1:
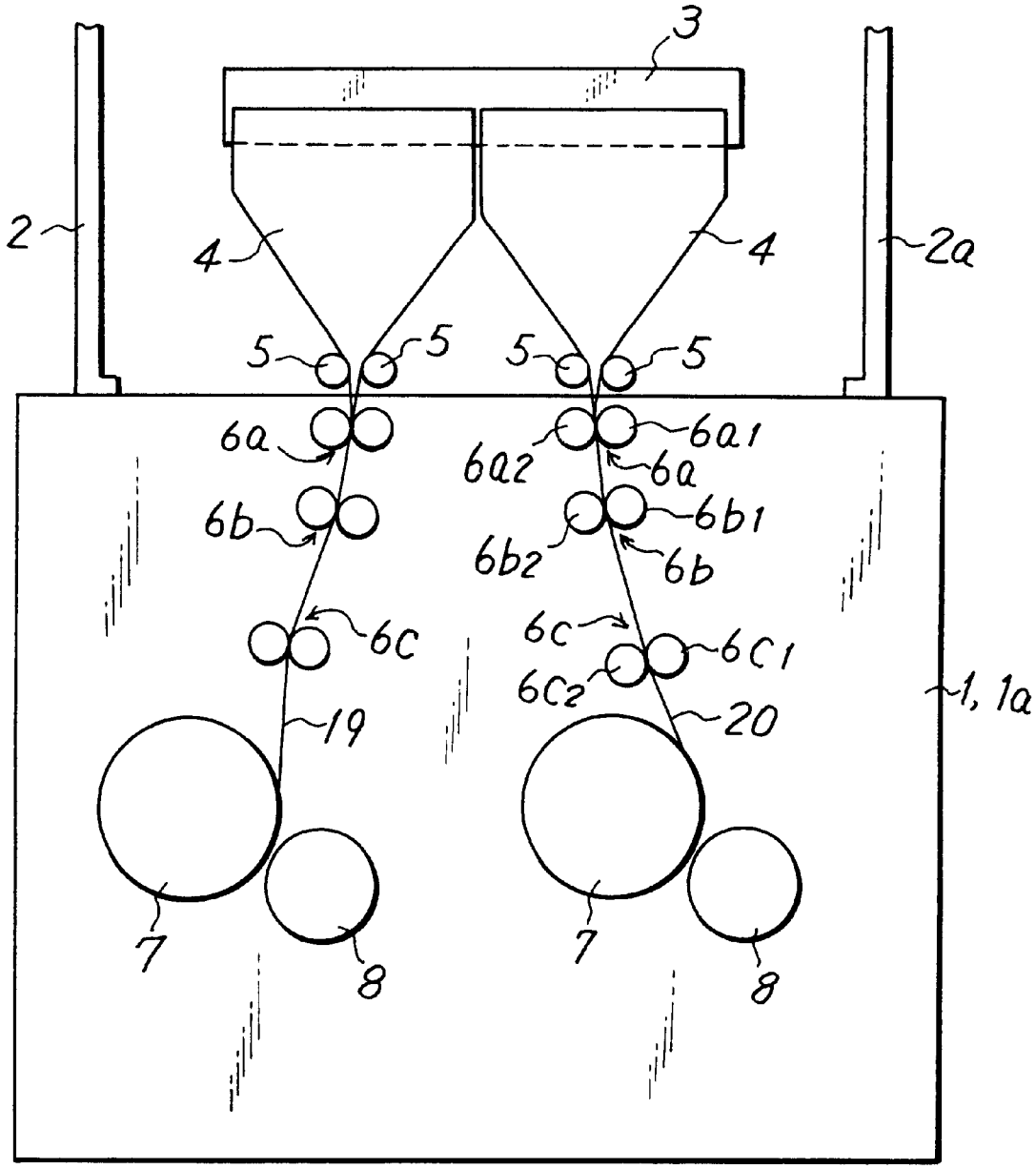
FIG. 1 is a schematic front view of a folding portion of a rotary press provided with a nipping-roller gap adjusting device in an embodiment of the invention.

FIG. 1 is a schematic front view of a folding portion of a rotary press provided with a nipping-roller gap adjusting device in an embodiment of the invention.

In FIG. 1, there are folding frames 1, 1*a* serving two folding machines of the same type, which are disposed right and left. Paper webs 19, 20 are collected on an above-former drag roller 3 rotatably supported by above-folder rail frames 2, 2*a*, folded by a former 4 into two parallel to the traveling direction, and pass through forming rollers 5 and a plurality of pairs of nipping rollers 6*a*, 6*b*, 6*c*. Usually, two pairs of nipping rollers 6*a*, 6*b* are installed as driving rollers under the former 4 which folds printed paper webs 19, 20 and a pair of nipping rollers 6*c* for combining paper webs 19, 20 fed from a plurality of formers is further installed.

The paper webs 19, 20 passing through the nipping rollers 6*a*, 6*b*, 6*c* are cut by a folding cylinder and a sawing cylinder 8 in the direction of 90° to the traveling direction and are discharged after being folded. Nipping rollers 6*a* comprise nipping roller 6*a*1 and nipping roller 6*a*. Nipping rollers 6*b* comprise nipping roller 6*b*1 and nipping roller 6*b*2. Nipping rollers 6*c* comprise nipping roller 6*c*1 and nipping roller 6*c*2.

The pressing force of the nipping rollers 6*a*, 6*b*, 6*c* applied to the paper webs 19, 20 is influenced by the tension setting for the traveling paper in a paper-feeding portion and the pressing force setting of a propeller roller on the above-former drag roller 3 and, therefore, delicate adjustments are often required during high-speed operation. Furthermore, the paper webs 19, 20 are not always of a uniform thickness due to irregularities in paper-making processes.

Therefore, when the paper webs 19, 20 are passing through the nipping rollers, the movable roller 6*a*1 of the nipping rollers constantly swings due to variations in the thickness of paper webs 19, 20. Accordingly, it is required that while the gap be adjusted to an appropriate level, a constantly uniform pressing force be maintained.

Otherwise, a condition in which a pressing force is not applied to the paper webs 19, 20 would be produced, with the result that the tension of paper webs would fluctuate greatly.

The surface speed of the nipping rollers 6*a*, 6*b*, 6*c* is a little higher than that of a printing cylinder and a little lower than that of the folding cylinder. Furthermore, slippage between the nipping rollers 6*a*, 6*b*, 6*c* and the paper webs 19, 20 is small if a force with which the nipping rollers 6*a*, 6*b*, 6*c* nip the paper webs 19, 20 is strong, and this slippage is large if this force is weak. By appropriately setting this force with which the nipping rollers 6*a*, 6*b*, 6*c* nip the paper webs 19, 20, it is possible to ensure good traveling capable of feeding the paper webs 19, 20 to the folding cylinder in a stable manner.

Therefore, in order to ensure good traveling of the paper webs 19, 20, it is necessary that the paper webs 19, 20 be held by the nipping rollers 6*a*, 6*b*, 6*c* between the former 4 and the folding cylinder 7 with an appropriate force. Furthermore, because paper webs folded by the former 4 are laid in a plurality of thicknesses, the laid paper webs are thick on the folded side and thin on the non-folded side. Therefore, it is necessary to adjust the nipping-roller gap independently for each of the two sides of nipping rollers.

The nipping-roller gap adjusting device is described below by taking adjustment on the side of the paper web 20 as an example.

Figure 2:
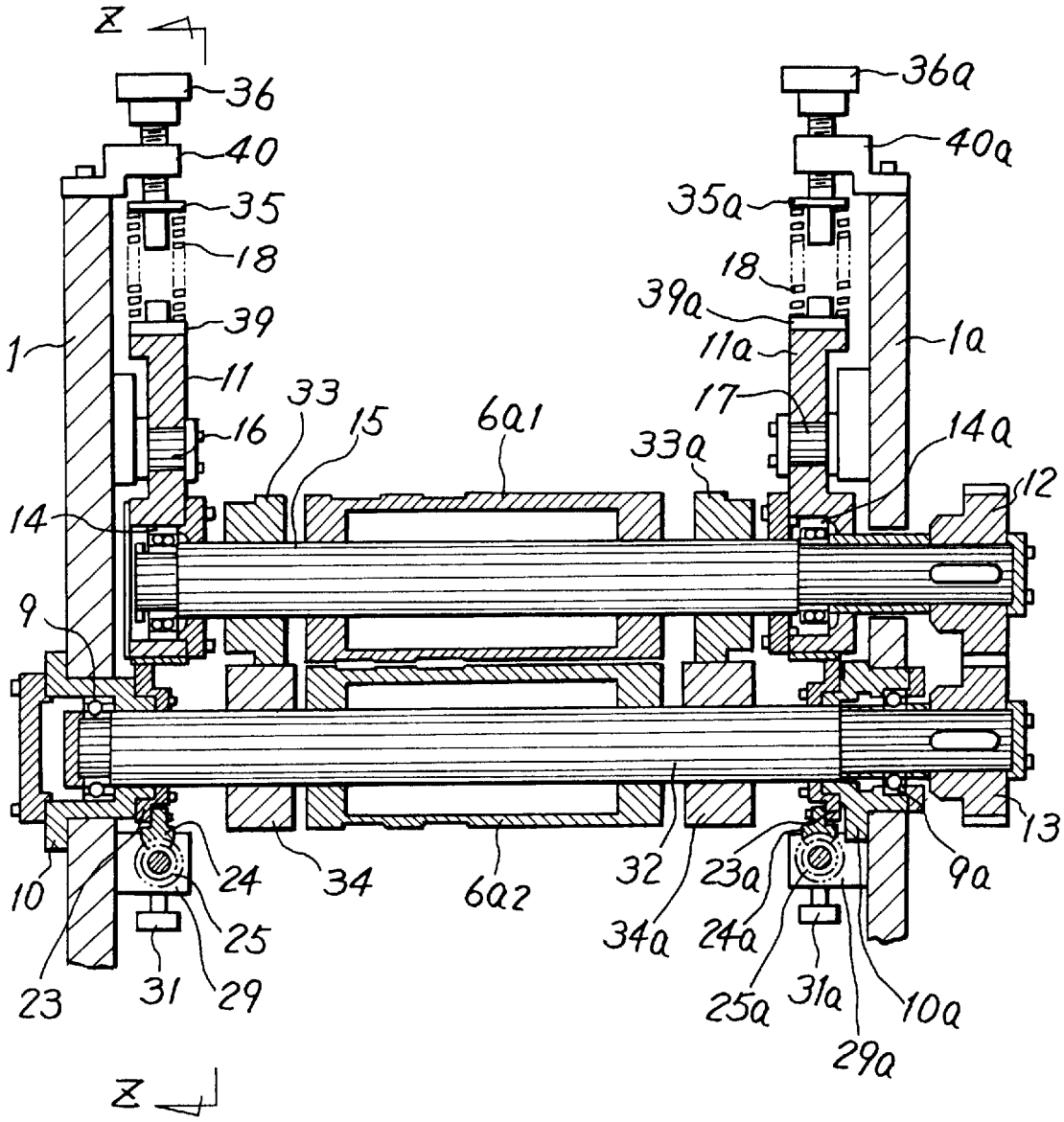
FIG. 2 is a side-by-side sectional view showing the whole of a nipping-roller gap adjusting device in an embodiment of the invention.
Figure 3:
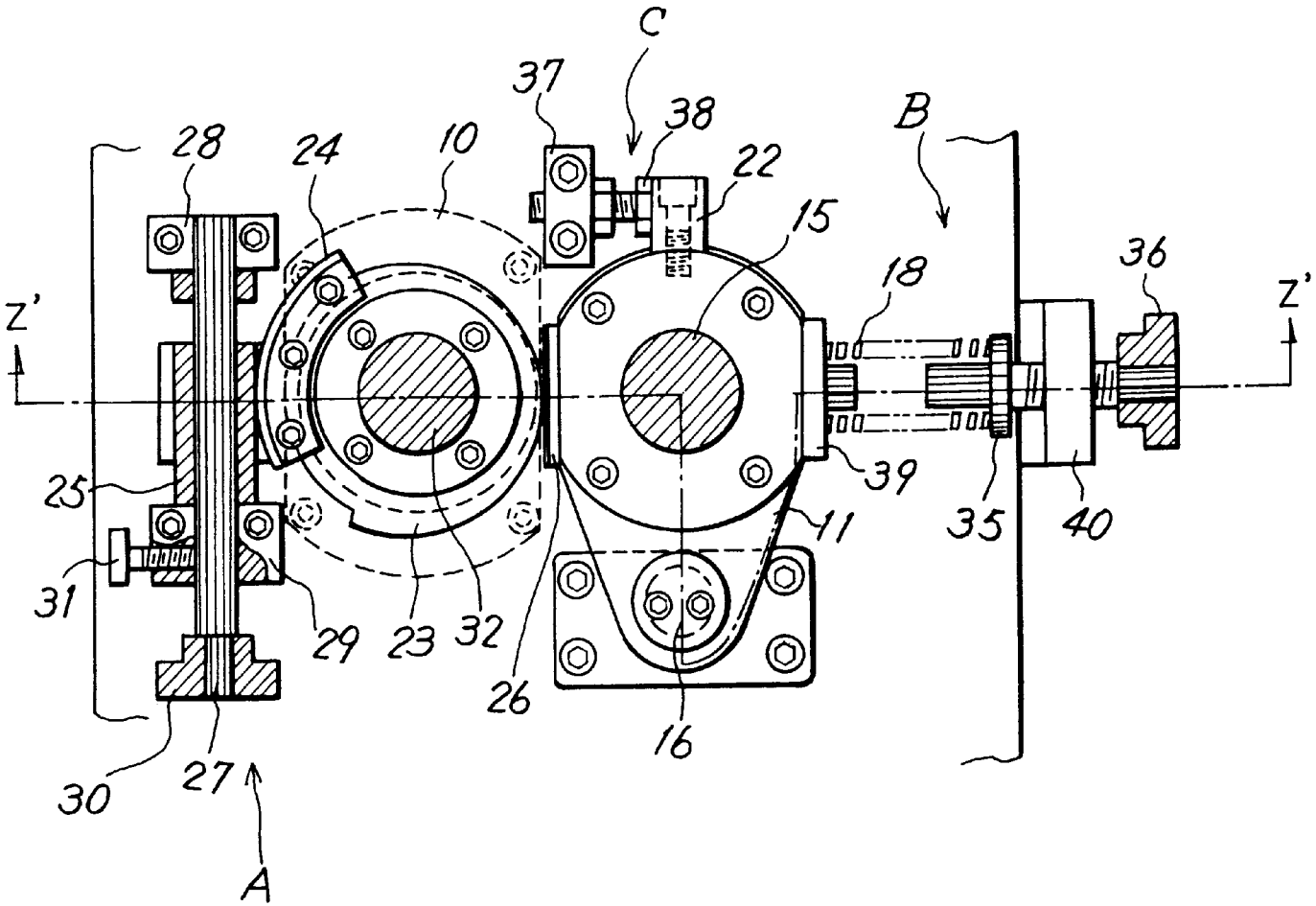
FIG. 3 is a view of nipping-roller gap adjustment in the embodiment of the invention, taken in the direction of arrows Z in FIG. 2.

FIG. 2 is a side-by-side sectional view showing the whole of a nipping-roller gap adjusting device in an embodiment of the invention; this sectional view was taken along the chain lines Z'—Z' of FIG. 3. FIG. 3 is a view of nipping-roller gap adjustment in an embodiment of the invention, taken in the direction of arrows Z in FIG. 2.

In FIG. 2 and 3, nipping rollers are composed of a stationary roller 6*a*2 and a movable roller 6*a*1, and the stationary roller 6*a*2 is rotatably supported by frames 1, 1*a* by means of bearing sleeves 10, 10*a*, which are supporting members, via a shaft 32 and bearings 9, 9*a*. Furthermore, the movable roller 6*a*1 is rotatably supported by a pair of supporting arms 11, 11*a* via a shaft 15 and bearings 14, 14*a*.

An end of the shaft 32 of the stationary roller 6*a*2 and an end of the shaft 15 of the movable roller 6*a*1 are each provided with a gear 13 and a gear 12, respectively, and these gears are driven by driving sources (omitted in the figures).

The shaft 32 of the stationary roller 6*a*2 is provided with split collars 34, 34*a* which approach the two ends of the stationary roller 6*a*2 each with an appropriate gap. And the shaft 15 of the movable roller 6*a*1 is provided with split collars 33, 33*a*, the peripheral surfaces of which are made of rubber and which approach the two ends of the movable roller 6*a*1 each with an appropriate gap.

As shown in FIG 2, the supporting arms 11, 11*a* are each swingably attached at one end thereof to the frames 1, 1*a* by means of supporting pins 16, 17, and the bearing sleeves 10, 10*a* of the stationary roller 6*a*2 are positioned with respect to the frames 1, 1*a* and are fixed thereto.

The pair of supporting arms 11, 11*a* which supports the movable roller 6*a*1 is provided with spring bearings 39, 39*a*, respectively, and a spring 18 is installed between these spring bearings 39, 39*a* and the carriers of the shafts 35, 35*a* which are brought into screw connection with brackets 40, 40*a*, which are attached ω the frames 1, 1*a* for these spring bearings 39, 39*a*. These components constitute the pressing force imparting means B.

In other words, a resiliency produced by each spring 18 works on the supporting arms 11, 11*a*, presses a paper web 20 folded and laid in layers parallel to the traveling direction, via the split collars 34, 34*a* and 33, 33*a* each installed on the shaft 15 of movable roller 6*a*1 and on the shaft 32 of stationary roller 6*a*2, and moves the paper web 20 by the rotation of the split collars 34, 34*a* and 33, 33*a*.

Eccentric cams 23, 23*a* are rotatably installed in the peripheral portions of the two bearing sleeves 10, 10*a* of the stationary roller 6*a*2, and segment worm wheels 24, 24*a* attached to the eccentric cams 23, 23*a* are engaged with worms 25, 25*a*. When the rotational operation of the worms 25, 25*a* is performed, the eccentric cams 23, 23*a* perform angular displacement along the peripheries of the two bearing sleeves on the center line of the shaft 32.

The cam surface of each of the eccentric cams 23, 23*a* is such that a portion having a maximum distance from the center of rotation to the cam surface and a portion having a minimum distance from the center of rotation to the cam surface adjoin each other with a level difference between the two and the distance increases gradually from the portion of minimum distance to the portion of maximum distance.

The worms 25, 25*a* are constructed so that they can rotate integrally with shaft 27 and a fight side shaft (not shown). The shaft 27 and the right side shaft are rotatably mounted on the frame 1 by means of bearing 28 and similar right side bearing (not shown) and bearings 29, 29*a* and are provided with handle 30 and a right side handle (not shown) at an end thereof. The portion with which the cans 23, 23*a* of the supporting arms 11, 11*a* of movable roller 6*a*1 come into contact are provided with impact plate 26 and the right side impact plate (not shown).

Stopper 22 and the right side stopper (not shown) for setting a minimum gap, which are the minimum gap setting means C, are attached to the supporting arms 11, 11*a* of the movable roller 6*a*1.

Stopper bracket 37 and a right side stopper bracket (not shown) are attached to the frames 1, 1*a*. Bolt 38 and a similar right side bolt (not shown) which are brought into screw connection with the stopper bracket 37 and the right side stopper bracket come into contact with the stopper 22 and the right side stopper attached to the supporting arms 11, 11*a* of the movable roller 6*a*1, whereby a minimum gap can be set so that in a case where the paper web 20 does not exist, etc., the collars 34, 34*a* installed on the shaft 32 of the stationary roller 6*a*2 and the collars 33, 33*a* installed on the shaft 15 of the movable roller 6*a*1 do not come into contact with each other.

Next, operation is described. First, by rotating the shaft 27 and the right side shaft, which are the gap adjusting means A, by means of the handle 30 and the right side handle, the eccentric cams 23, 23*a* are caused to undergo angular displacement, for example, in a clockwise direction in FIG. 3 via the worms 25, 25*a* and segment worm wheels 24, 24*a*.

Then, the eccentric cams 23, 23*a* increase in the distance from the center of rotation thereof to the eccentric cam surfaces in contact with the impact plate 26 and the right side impact plate and work in such a way that they press the supporting arms 11, 11*a* in a right direction in FIG. 3 while resisting the force of the spring 18t with the result that the gap between the stationary roller 6*a*2 and the movable roller 6*a*1 increases, When gap-adjusting operation has been completed, the shaft 27 is fixed by means of clamp handles 31, 31*a*. When setting is to be changed from a thick page to a thin page, by rotating the shaft 27 and the right side shaft in the direction reverse to the above direction by means of the handle 30 and the right side handle, the eccentric cams 23, 32*a* are caused to undergo angular displacement in a counterclockwise direction in FIG. 3 via the worms 25, 25*a* and the segments worm wheels 24, 42*a*.

Then, the eccentric cams 23, 23*a* decrease in the distance from the center of rotation thereof to the eccentric cam surfaces in contact with the impact plate 26 and the opposite impact plate.

Then, the supporting arms 11, 11*a* are pressed by the force of the spring 18 in a left direction in FIG. 3, with the result that the gap between the stationary roller 6*a*2 and the movable roller 6*a*1 decreases. In this case, a mum gap is set beforehand by means of the minimum gap setting means C and, therefore, a minimum gap between the movable roller 6*a*1 and the stationary roller 6*a*2 is kept even if the shaft 27 and the right side shaft are excessively turned, with the result that the collars 33, 33*a* and the collars 34, 34*a* do not come into contact with each other.

In the illustrated embodiment, the cam shape is such that the displacement in a straight line direction occurring between the movable roller 6*a*1 and the stationary roller 6*a*2 has an almost proportional relationship with the circumferential displacement of the eccentric cams 23, 23*a*, thereby making adjusting work and control simple. Furthermore, the amount of circumferential displacement of the eccentric cams 23, 23*a* can be increased by the reduction gear ratio of the worms 25, 25*a* and segment worm wheels 24, 24*a* and, therefore, delicate adjustments are possible in the adjustment of the gap between the movable roller 6*a*1 and stationary roller 6*a*2 of nipping rollers.

Driving means such as a motor (not shown) may be used for the rotation of the shaft 27, and besides a potentiometer (not shown) for detecting amounts of adjustment may be installed and connected via control means (not shown) to the driving means, which is not shown, whereby the gap adjusting means A can operate under automatic control.

Next, the force that presses the paper web 20 passing through the movable roller 6*a*1 and the stationary roller 6*a*2 can be changed by changing the force of the spring working on the supporting arms 11, 11*a*. This change of the spring force is accomplished by rotating the shafts 35, 35*a*, which are the pressing force imparting means B, by means of the handles 36, 36*a*, whereby the spring bearing is moved in the axial direction of the shafts 35, 35*a* by the rotation of the shafts 35, 35*a*.

Furthermore, in the pressing force imparting means B, a hydraulic cylinder may be used in place of the spring 18, thereby to adjust the pressing force by adjusting the hydraulic pressure supplied to this hydraulic cylinder by means of a adjusting device. Also, driving means such as a motor (not shown) may be used for the rotation of the shafts 35, 35*a*, and besides a potentiometer (not shown) for detecting amounts of adjustment may be installed and connected via control means (not shown) to the driving means, which is not shown, whereby the pressing force imparting means B can operate under automatic control.

The feature of this embodiment resides in that the two essential means in nipping rollers, i.e., the gap adjusting means A, which causes the eccentric cams 23, 23*a* to undergo angular displacement by means of the worms 25, 25*a* and segment worm wheels 24, 24*a*, and the pressing force imparting means B, which gives a pressing force to the supporting arms 11, 11*a* with the aid of the resiliency of the spring 18, are separately installed in the movable roller portion and the stationary roller portion, respectively.

As a result, through the use of the gap adjusting means A installed in the stationary roller portion, everyone can easily, positively and accurately perform gap adjustment without the influence of the swinging motion of the supporting arms 11, 11*a* observed in prior art. And through the use of the pressing force imparting means B, everyone can easily, positively and accurately adjust the pressing force working on the supporting arms 11, 11*a* without the influence of the swinging motion of the supporting arms 11, 11*a*.

Furthermore, because the gap adjusting means A and the pressing force imparting means B are separately constructed, a very simple construction could be given to the two means. Also, because the contact portions of the gap adjusting means are composed of the eccentric cams 23, 23*a* and impact plates 26 (and right side impact plate) and because the eccentric cams 23, 23*a* are fitted onto the bearing sleeves 10, 10*a* having high rigidity, which in turn are further fitted onto the folding frames 1, 1*a*, irregularities such as deformation and misalignment do not occur in the gap adjusting mechanism even when a thick paper sheet with a thickness larger than a setting, such as self-adhesive paper , passes and the gap adjusting mechanism receives an impact load generated by the passage. Furthermore, because no adjusting screw is used in the gap adjusting means, the problem that accumulation of paper powder, etc. makes gap adjustment impossible does not come up.

The invention is not limited to the above embodiment and includes design changes that do not deviate from the scope of the invention.

As mentioned above, according to the invention, the gap adjusting means are installed on the stationary roller side and the pressing force imparting means are installed on the movable roller side and, therefore, the operating portions of the two means are not influenced by the swinging motion of the supporting arms even during the operation of a machine. Accordingly, whether a machine is in operation or out of operation, every one can easily, positively and accurately perform the gap adjustment and pressing force adjustment of nipping rollers.

Furthermore, because the gap adjusting means A and the pressing force imparting means B are separately constructed, a very simple construction could be given to the two means. Because of the simple construction, maintenance is easy and besides maintenance may be carried out at a low frequency. In addition, the possibility of breakdowns could be reduced.

Furthermore, because the gap adjusting means are installed in the bearing sleeve portion, irregularities such as deformation and misalignment do not occur in the adjusting mechanism even when a thick paper sheet with a thickness larger than a setting such as self-adhesive paper passes and an impact load generated by the passage of the thick paper is applied to the adjusting mechanism. In addition, because no adjusting screw is used in the gap adjusting means, the problem that accumulation of paper powder, etc. makes gap adjustment impossible does not come up.

What is claimed is:

1. A nipping-roller gap adjusting device in a rotary press which is provided with nipping rollers including a positioned roller rotatably provided at a prescribed position and a movable roller, the nipping rollers are adapted so that the movable roller is capable of forcing a paper web passing between the nipping rollers onto the positioned roller, the nipping-roller gap adjusting device comprising:

a pair of supporting arms, a supported end of each of the supporting arms being swingably supported and a supporting end of each of the supporting arms rotatably supporting the movable roller;

a pressing force imparting means which applies a force working to the supporting arms in such a direction that causes the movable roller to approach the positioned roller, the pressing force imparting means adjusting the magnitude of the force, a minimum gap setting means for setting a minimum gap between the positioned roller and the movable roller;

a gap adjusting means which is supported together with the positioned roller and which adjusts a distance making the movable roller approach the positioned roller; and a fixed frame member which rotatably supports the positioned roller, the gap adjusting means being mounted on the fixed frame member.

2. A nipping-roller gap adjusting device according to claim 1, wherein the gap adjusting means comprises an eccentric cam rotatably installed on the peripheral surface of a bearing sleeve which rotatably supports the positioned roller and a worm gearing for the rotary operation of the cam.

3. A nipping-roller gap adjusting device according to claim 1, wherein the pressing force imparting means is provided with a pressing element, one end of which is supported by the fixed frame member and the other end of which is in contact with the supporting arms, whereby the pressing element presses the supporting arms.

4. A nipping roller gap adjusting device according to claim 1, wherein the minimum gap setting means is provided with a stopper for minimum gap setting installed adjacent to the supporting end of the supporting arms and wherein the position of the stopper is adjustable with respect to the fixed frame member.

5. A nipping-roller gap adjusting device according to claim 1, wherein a collar corresponding to the positioned roller is installed coaxially therewith and another collar corresponding to the movable roller is installed coaxially therewith, either or both of the collars having elasticity at least on a peripheral surface thereof.

6. A nipping-roller gap adjusting device for nipping rollers including a positioned roller rotatably provided at a prescribed position and a movable roller, the movable roller for forcing a paper web passing between the nipping rollers onto the positioned roller, the nipping-roller gap adjusting device comprising:

a pair of supporting arms, each of said supporting alms including a supported portion swingably supported and a supporting portion rotatably supporting said movable roller;

pressing devices, each of said pressing devices pressing a respective one of said supporting arms to cause said movable roller to approach said positioned roller, a pressing force of said pressing devices being adjustable;

minimum gap setting elements setting a minimum gap between said positioned roller and said movable roller;

a gap adjustor supported together with said positioned roller to adjust a distance said movable roller approaches said positioned roller, and a fixed frame member which rotatably supports said positioned roller, said gap adjustor being mounted on said fixed frame member.

7. A nipping-roller gap adjusting device according to claim 1, wherein said gap adjustor comprises:

an eccentric cam rotatably connected to a peripheral surface of a bearing sleeve rotatably supporting said positioned roller; and a worm gear for said rotary operation of said cam.

8. A nipping-roller gap adjusting device according to claim 6, wherein said pressing devices each have a pressing element supported by said fixed frame member and in contact with a respective one of said supporting arms.

9. A nipping roller gap adjusting device according to claim 6, wherein said minimum gap setting elements each have a stopper installed adjacent to a respective said supporting portion of said supporting arms and therein a position of said stopper is adjustable with respect to said fixed frame member.

10. A nipping-roller gap adjusting devise according to claim 6, wherein a collar corresponding to the positioned roller is installed coaxially therewith and another collar corresponding to the movable roller is installed coaxially therewith, either or both of the collars having elasticity at least on a peripheral surface thereof.

* * * * *

UNITED STATES PATENT AND TRADEMARK OFFICE

CERTIFICATE OF CORRECTION

PATENT NO. : 6,533,154 B2 
DATED : March 18, 2003
INVENTOR(S) : Mitsuo Kitai, Takanobu Sakakura and Yuuji Iiizumi It is certified that error appears in the above-identified patent and that said Letters Patent is hereby corrected as shown below:

Title page,
Item [73], Assignee, should read -- Tokyo Kikai Seisakusho, Ltd. (JP) --

Signed and Sealed this

Nineteenth Day of August, 2003

JAMES E. ROGAN
*Director of the United States Patent and Trademark Office*